US005526631A

United States Patent [19]

Murakami

[11] Patent Number: 5,526,631

[45] Date of Patent: Jun. 18, 1996

[54] STORAGE DEVICE FOR UMBRELLA SACKS

[75] Inventor: Toshiyuki Murakami, Sagamihara, Japan

[73] Assignees: Kabushiki Kaisha Muraharu Seisakusho, Kanagawa; Niikura Scales Co., Ltd.; Kabushiki Kaisha Yakul't Honsha, both of Tokyo, all of Japan

[21] Appl. No.: 256,291

[22] PCT Filed: Dec. 22, 1993

[86] PCT No.: PCT/JP93/01851

§ 371 Date: Oct. 26, 1994

§ 102(e) Date: Oct. 26, 1994

[87] PCT Pub. No.: WO94/14660

PCT Pub. Date: Jul. 7, 1994

[30] Foreign Application Priority Data

| | | | |
|---|---|---|---|
| Dec. 22, 1992 | [JP] | Japan | 4-092370 U |
| Nov. 26, 1993 | [JP] | Japan | 5-321070 |
| Nov. 26, 1993 | [JP] | Japan | 5-321071 |

[51] Int. Cl.[6] ..... B65B 67/00

[52] U.S. Cl. ..... 53/390; 53/570; 53/571; 53/255

[58] Field of Search ..... 53/390, 570, 571, 53/572, 255, 258; 248/95, 99, 100

[56] References Cited

U.S. PATENT DOCUMENTS

| | | | |
|---|---|---|---|
| 2,899,788 | 8/1959 | Beebe | 53/570 |
| 3,468,100 | 9/1969 | Rubel | 53/572 |
| 3,783,580 | 1/1974 | Raudys | 53/572 |
| 3,896,605 | 7/1975 | Chevalier | 53/570 |
| 4,253,292 | 3/1987 | Lipes | 53/572 |
| 4,368,608 | 1/1983 | Ray | 53/572 |
| 4,370,845 | 2/1983 | Perolls et al. | 53/572 |
| 4,791,776 | 12/1988 | Jackman et al. | 53/570 |

FOREIGN PATENT DOCUMENTS

| | | |
|---|---|---|
| 58-149914 | 10/1983 | Japan . |
| 60-134817 | 7/1985 | Japan . |
| 62-125708 | 8/1987 | Japan . |
| 1-124120 | 8/1989 | Japan . |
| 4-31222 | 2/1992 | Japan . |
| 4-31229 | 2/1992 | Japan . |
| 4-95720 | 8/1992 | Japan . |
| 5-7611 | 2/1993 | Japan . |

*Primary Examiner*—John Sipos
*Assistant Examiner*—Gene Kim
*Attorney, Agent, or Firm*—Armstrong, Westerman, Hattori, McLeland & Naughton

[57] ABSTRACT

The storage device for umbrellas sacks of the present invention comprises: a body where a number of storage sacks are stored; a movable support base arranged to move vertically in the body; a wear plate that makes said movable support base lower when it contacts an edge of an umbrella; and open control levers that open the storage sacks in the descending motion of said movable support base. The storage device is structured so that the umbrella can be automatically inserted in the storage sack when the open control levers open the storage sack in the descending motion of the movable support base by contacting the wear plate with the edge of the umbrella. The wear plate simultaneously sweeps back by rotating downward.

5 Claims, 14 Drawing Sheets

STORAGE DEVICE FOR UMBRELLA SACKS

BACKGROUND OF THE INVENTION

1. Field of the Invention

The present invention relates to a storage device for wet umbrellas that automatically wraps the umbrella in a sack. It can be used, for example, at an entrance of hotels, shops and department stores, so that, when it is raining, the umbrella can be adequately handled and stored.

2. Description of the Prior Art

When it is raining, synthetic resin sacks (plastic sacks) have, traditionally, been used to wrap wet umbrellas in order to avoid wetting clothes, floors or good while the customers walk around carrying wet umbrellas inside hotels, shops or department stores.

As shown in Japanese Patent Application No. 60-134817, Japanese Utility Model Publication No. 62-125708 and Japanese Patent Application No. 4-31222, a variety of storage devices, that can open a storage sack and store an umbrella by just inserting the umbrella into an opening, have been proposed to ease the storage operation.

In the prior method, as mentioned above, there can be complex structure problems as a result of the negative pressure suction, as a means to open the storage sacks, with the number of links, or with the cam mechanism. In addition, because a vacuum pump or a motor is used, the production cost increases and such devices cannot be used where a power source is not available close to the devices. Power cords are a hindrance and there is danger of a short circuit when the devices are operated and it is raining.

In consideration of the above-mentioned problems, the present invention is proposed to solve such problems. With regards to the present invention, no power source is required. The invention provides a simple structured device so that umbrellas can easily be stored in storage sacks.

BRIEF DESCRIPTION OF THE INVENTION

As the storage sacks used in the device, the upper open end of the sacks and the upper fore side of the sack opening is folded and the upper rear side is projected above that of the fore side and locking holes are provided at the upper side of such projected portion.

In one embodiment of the present invention, a number of storage sacks are charged in a storage device and the openings of said sacks are open so that each umbrella can be stored in such a sack. A box, in which a number of storage sacks are stored, is charged into the storage device. Such a structure is one of preferred embodiments of the present invention. In this case, the selected embodiment of the storage sack is that the sacks are retained in such a box by suspending such sacks with a hanger.

In addition, according to embodiments of the open control levers, a pair of open control levers are provided to move and rotate independently for the above-mentioned movable support member. In this case, with regards to means for moving and rotating the open control levers in a certain direction to contact with storage sacks charged in the storage device, preferred means are provided independently for each lever.

Besides, the open control levers can be comprised of a bucket-shaped member made with a non-friction material (e.g. resin materials such as plastic). In this case, a structure of the device body is not limited to a casing structure. For example, it can be structured using only pillars. Transparent members can be arranged between such pillars.

According to the above mentioned structure of the umbrella sack storage device of the present invention, the open control levers open the sacks by contacting each edge of the umbrella to be stored with the wear plate and by lowering the movable support base. Simultaneously, the wear plate sweeps back by rotating downward in order to insert each umbrellas automatically into each storage sack. As a result, storing umbrellas into storage sacks is carried out without using a motor.

In addition, according to the storage sacks of the present invention, a number of storage sacks can be retained in the device by providing a cylindrical hanger to suspend them through the locking holes provided at an upper edge of the projected portion. The open control levers can be inserted into the openings reliably in order to open such opening by folding the upper end of the fore side sack opening.

According to the prior art, a number of storage sacks are simply piled up to charge them into the storage device, and it is often difficult to store them due to dispersion problems. Besides, it is not easy to store or carry a number of such storage sacks before they are charged into the storage device. However, according to the storage device for umbrella sacks of the present invention, in which a number of storage sacks are stored, such storage sacks can be charged into the storage device. In this case, it is possible to charge a larger number of storage sacks at once, easily and rapidly. Besides, it is easy to store or carry many sacks before they are charged into the storage device since they are packed in one box.

In the present invention, when the open control levers are structured as a pair of open control levers and move and rotate independently from the movable support member and when the means are structured independently for each lever, as it makes the open control levers move and rotate in the direction to contact with the storage sacks charged in the storage device, the opening will be certainly open despite the misregistration that can be generated around the opening.

On the other hand, when the open control levers are structured by bucket-shaped members, formed with slippery materials, such as, resin materials, e.g., plastic, the insertion of umbrellas can be done easier and with greater certainty.

BRIEF DESCRIPTION OF THE DRAWINGS

The present invention will be more fully described and better understood from the following description of preferred embodiments, taken with the appended drawings, in which.

DETAILED DESCRIPTION OF THE PREFERRED EMBODIMENTS

Figure 1:
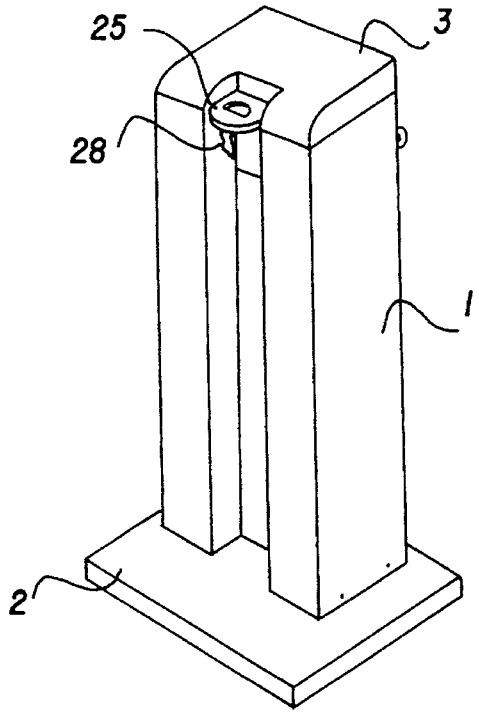
FIG. 1 is an oblique section view showing a preferred embodiment of the storage device for umbrellas sacks of the present invention.
Figure 2:
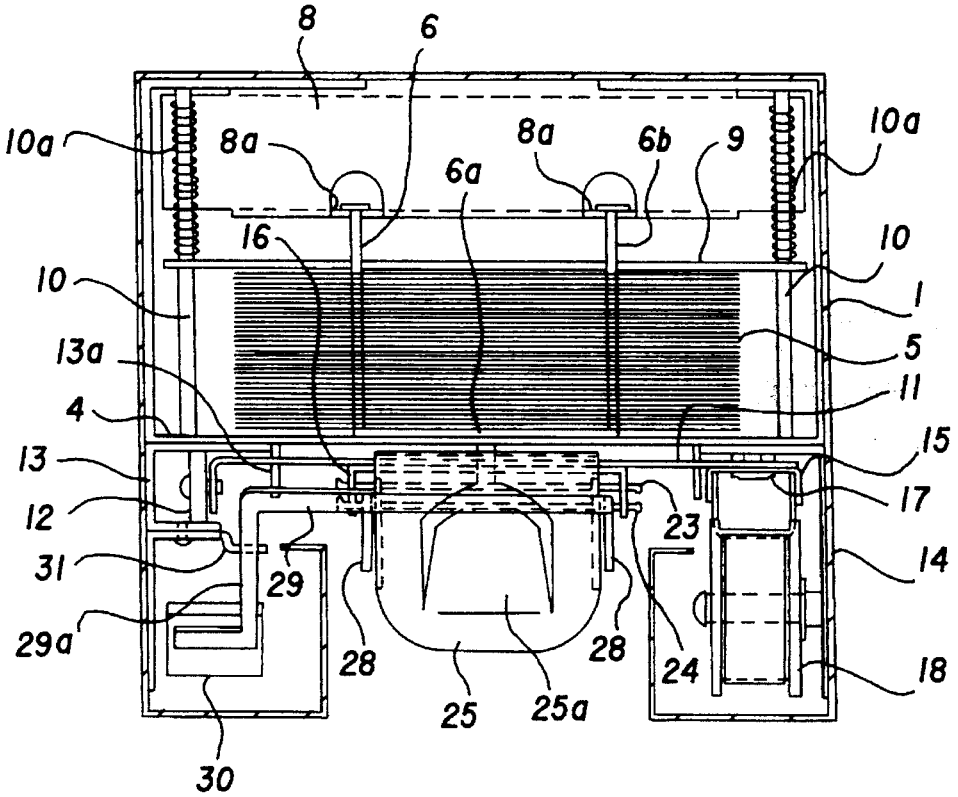
FIG. 2 is an enlarged plan view of the embodiment in FIG. 1 in an opening state with the upper cover removed.
Figure 3:
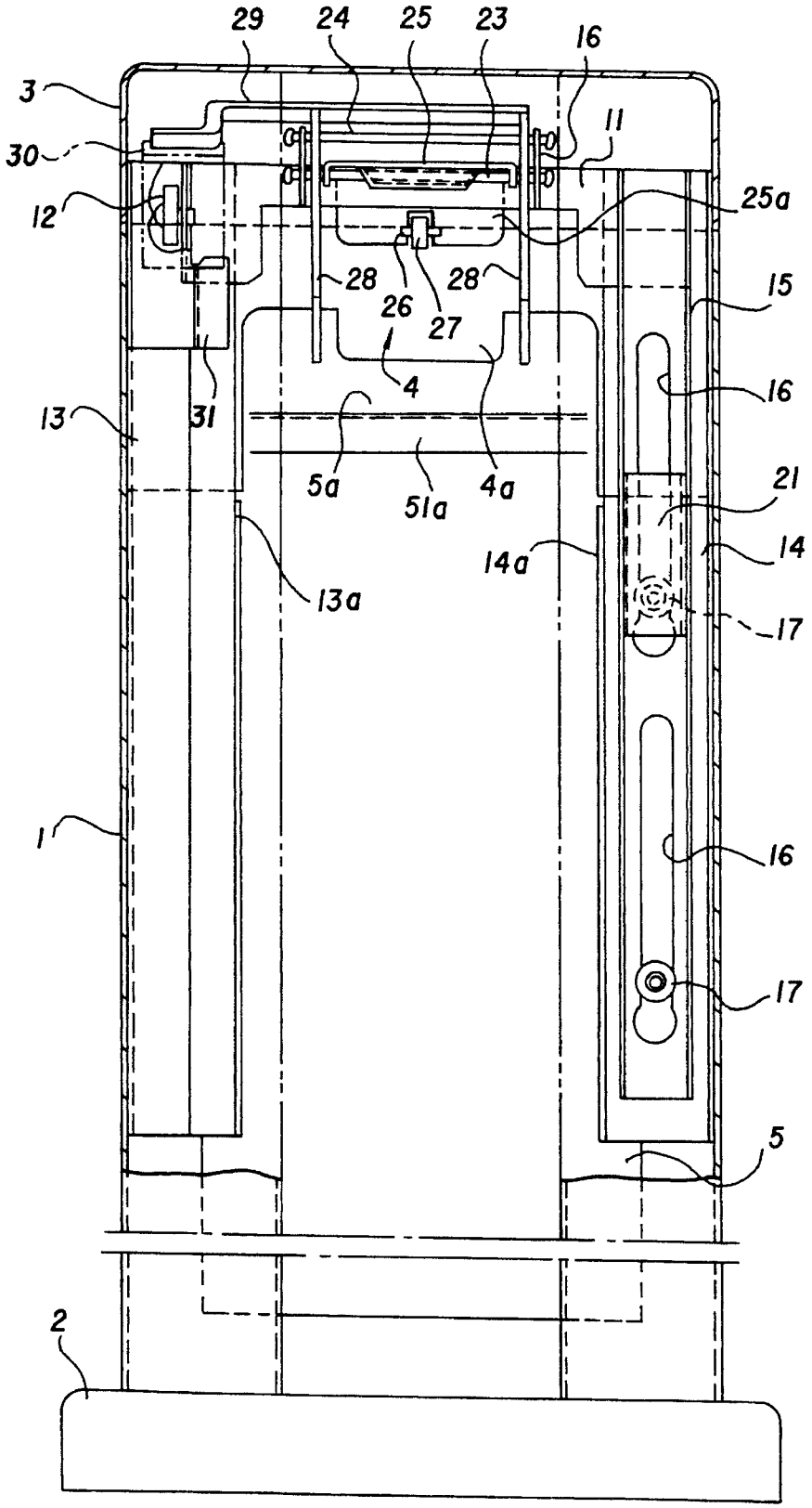
FIG. 3 is a longitudinal front view of the embodiment in FIG. 1, with the front cover removed.
Figure 4:
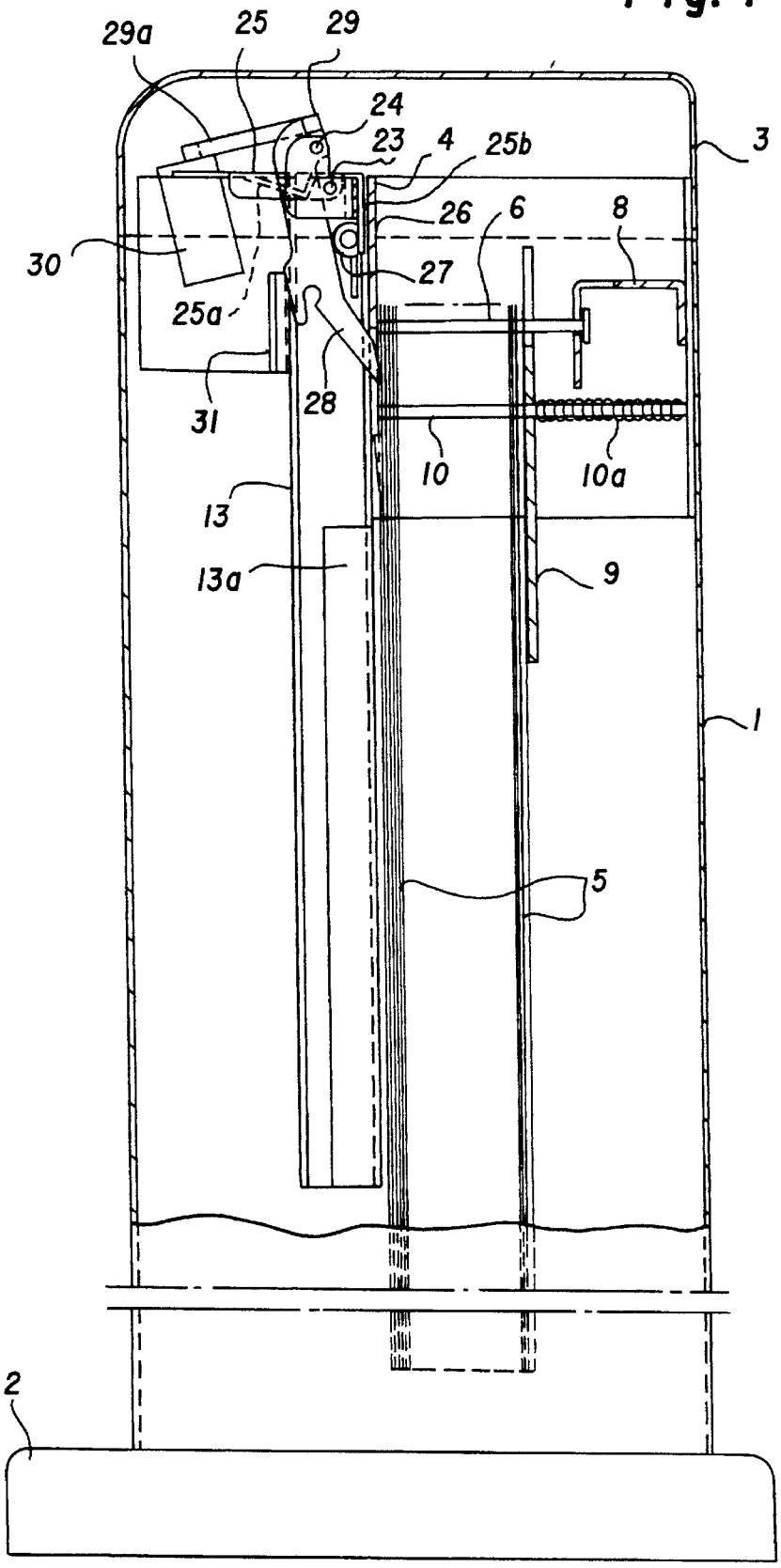
FIG. 4 is a longitudinal side view of the embodiment shown in FIG. 1, with the side cover removed.

In FIG. 1 to FIG. 8, a quadratic prism-shaped housing has a front face with a recess situated on a base 2; a closing cover 3 in installed on top of case 1. As shown in FIG. 2 and FIG. 4, a fixed support base 4 is mounted inside of the upper part of housing 1; a hanger 6 is suspended to retain storage sacks 5 formed from synthetic resin film, and the like, is set on the fixed support base 4.

Figure 5:
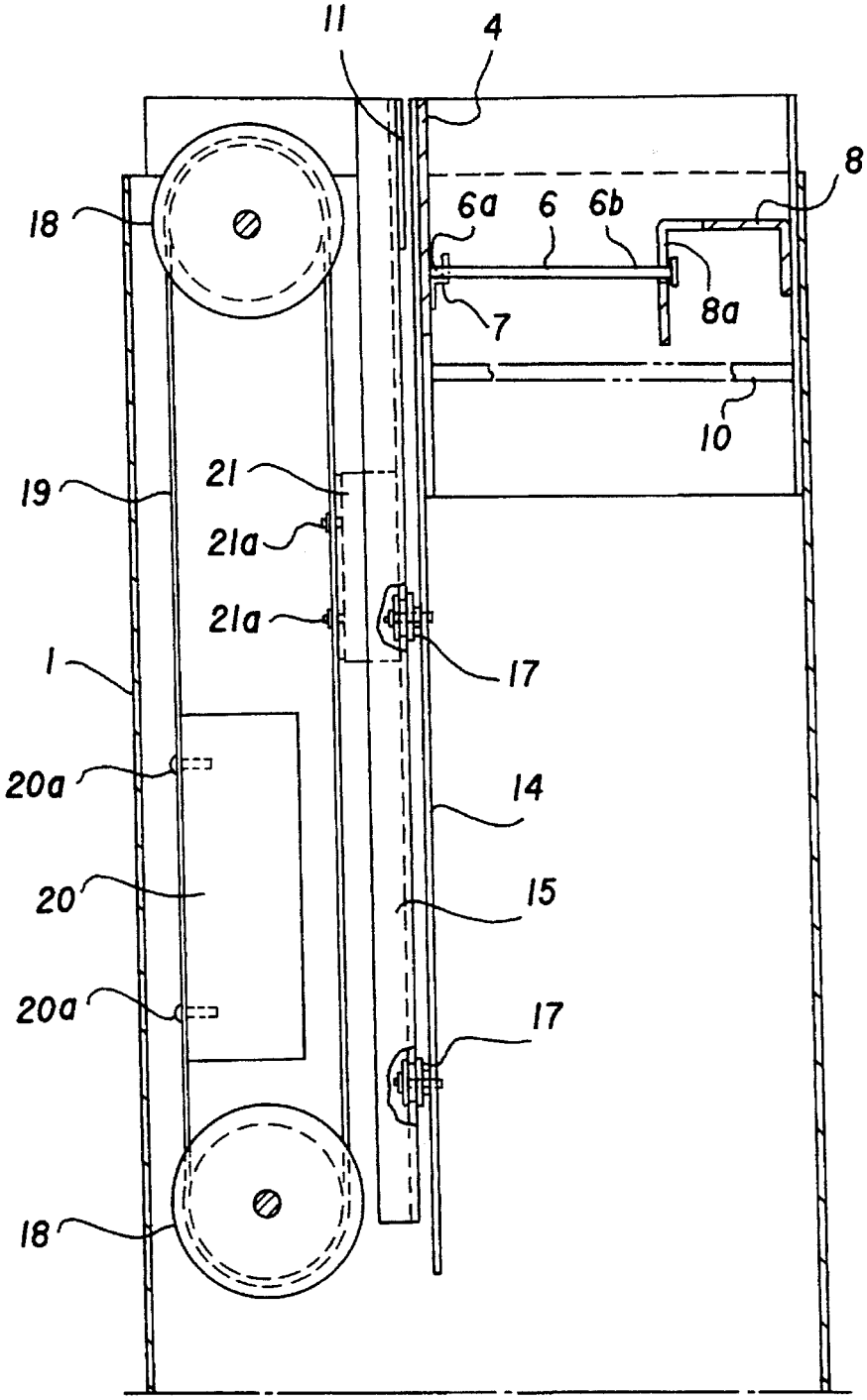
FIG. 5 is a longitudinal side view showing the arrangement structure of a plumb that allows the movable support base to ascend.
Figure 6:
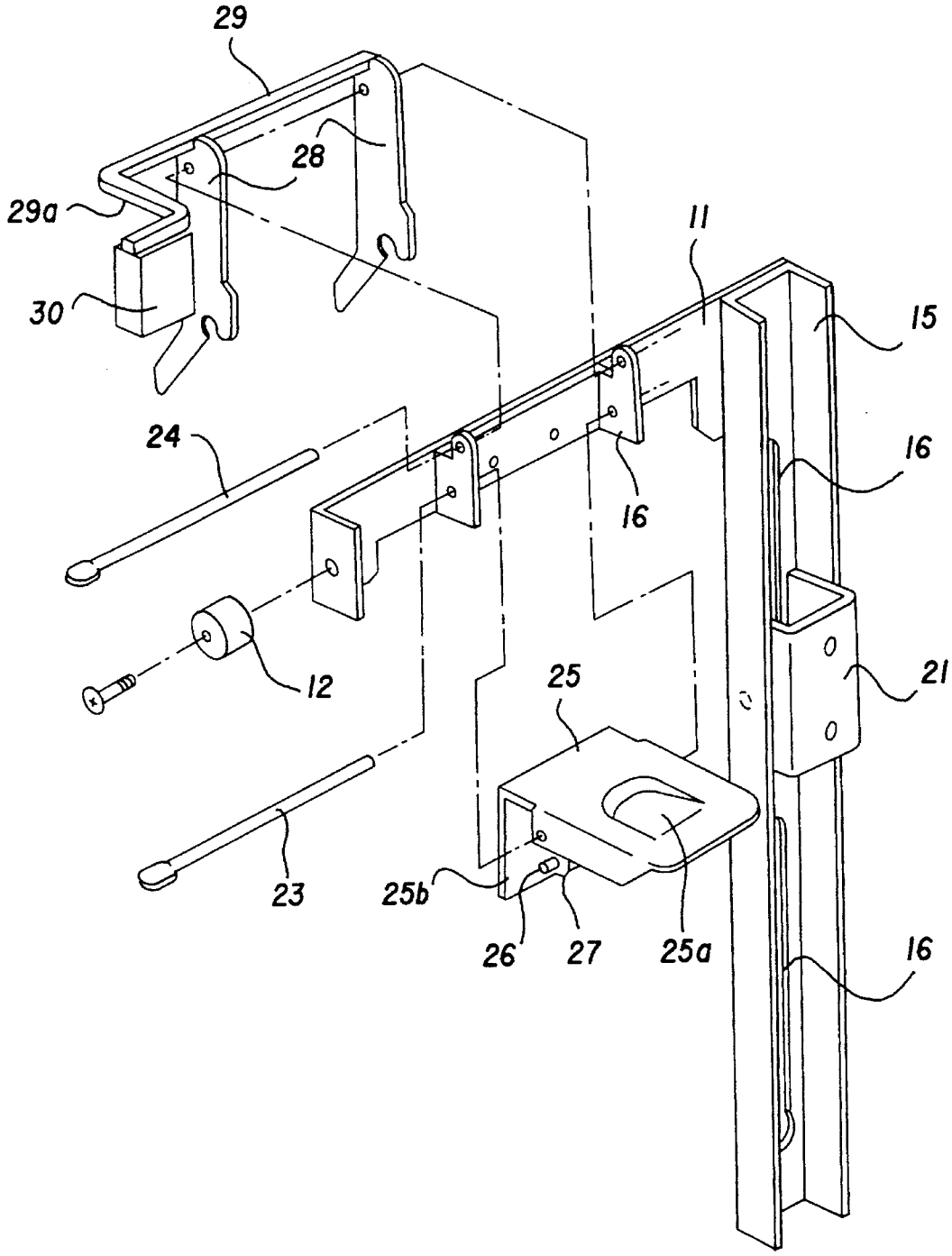
FIG. 6 is an exploded perspective view showing the pivots.

As shown in FIG. 2, the box type hanger 6 is comprised of a bar, and the like, formed in box type, top-open, rectangle-shaped; and, as shown in FIG. 5, cover 3 is open; a base 6*a* of the box type hanger 6 is anchored to a hook 7 mounted on fixed support base 4; and hanger 6 is removably installed by hitching both removable ends 6*b*, 6*b* to anchor holes 8*a* of a support member 8 which member is fixed to the fixed support base 4.

Figure 7A:
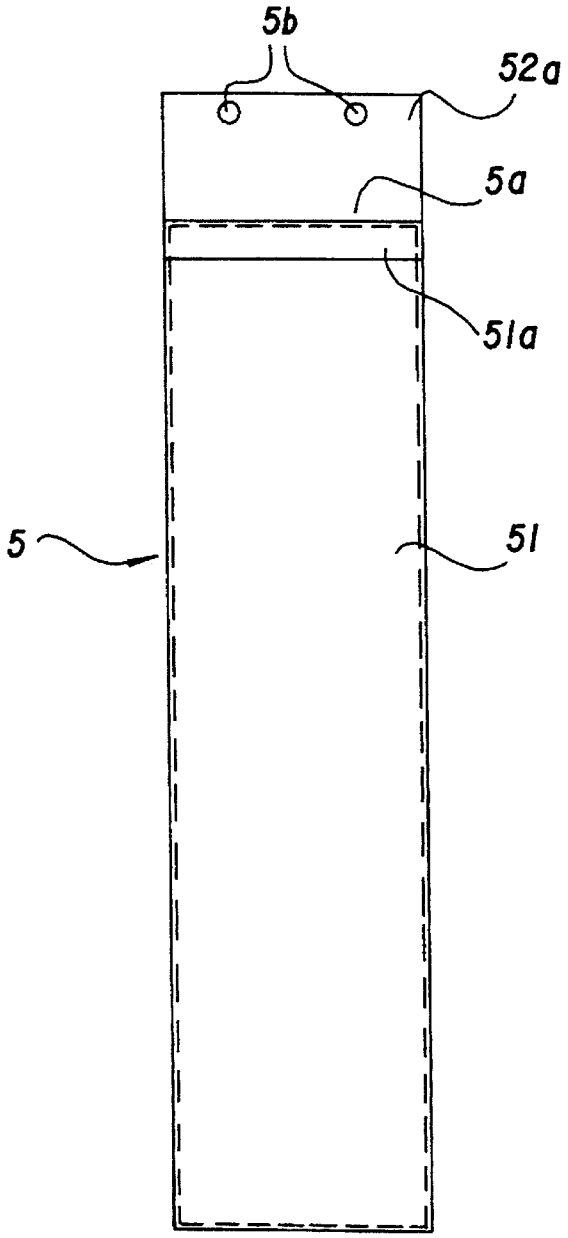
FIGS. 7(A) and 7(B) are, respectively, a front view and a side section view of the storage sack.
Figure 7B:
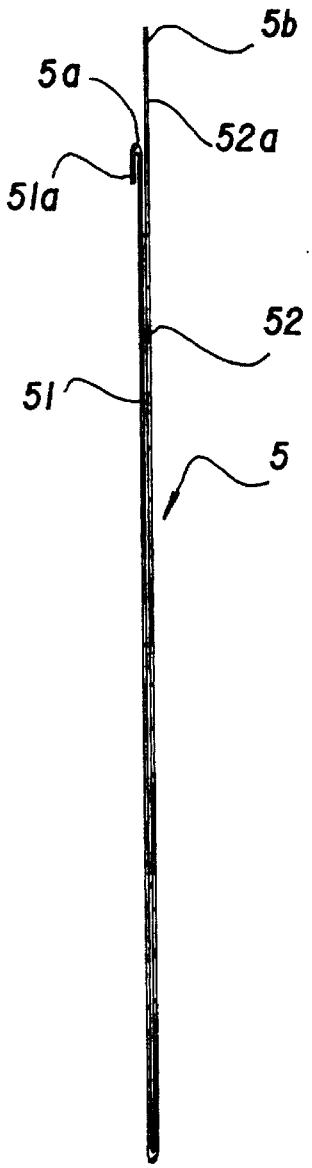

On the other hand, as shown in FIGS. 7A, 7B, the upper part of a storage sack 5 has an opening 5*a;* the upper end 51*a* of the fore side 51 of the opening is folded forward or may be folded backward in a U-shape; the upper end 52*a* of the rear side 52 is projected above the upper edge of the fore side 51; and a pair of locking holes 5*b* are provided at the upper end of the projected portion of rear end 52*a*.

As shown in FIG. 2 and FIG. 4, a number of storage sacks are suspended in order to retain them by inserting each opposing arm of the aforementioned box type hanger 6 into each locking hole 5*b*.

A pressure plate 9, FIG. 2, is movably installed along a pair of guide bars 10, 10 on the rear face of storage sacks 5 and pressure plate 9 is constantly pressed to the rear face of storage sacks 5 by a coil spring 10*a* on each guide bar.

As shown in FIG. 2 and FIG. 3, a box type guide rail 13 is installed, vertically, at one horizontal end of the front face of the fixed support base 4; a support member 14 is installed, vertically, at the other horizontal end of the front face of the base 4; and a movable support base 11 is arranged on the front face of the fixed support base 4.

A rotating roller 12, which is rotatably arranged at one end of the movable support base 11, is positioned in the guide rail 13; as shown in FIG. 3, a pair of long holes 16, 16 are vertically formed on the box type guide member 15 mounted on the other end of the movable support base 11; and the movable support base 11 is retained vertically to the fixed support base 4 by hitching a grooved roller 17 to the support member 14.

Additionally, a pair of pulleys 18, 18 are installed vertically on support member 14 in front of the guide member 15 as shown in FIG. 2 and FIG. 5; the plumb 20 is mounted by screws 20*a*, 20*a* on one side of tense belt 19 and rotated with both pulleys 18, 18; and the movable support base 11 constantly moves vertically by connecting the other side of belt 19 with connecting member 21 fixed to guide member 15 using screws 21*a*, 21*a*. A stopper is mounted on the fixed support base 4 for anchoring the movable support base 11 at the fixed ascending position as shown in FIG. 3 so as to limit the ascending motion of movable support base 11. In FIG. 2 and FIG. 3, stoppers 13*a* and 14*a* are formed by bending one end of the guide rail 13 and support member 14 in a forward direction so as to limit the descending motion of the movable support base 11.

A shown in FIG. 2 and FIG. 4, a pair of supporting shafts 23, 24 are provided on the upper central front face of the movable support base 11 through a bearing 16. A wear plate 25, which lowers the movable support base 11 by contacting with a shoe at the edge of umbrella, is provided on a supporting shaft 23.

Concave 25*a*, which contacts with the shoe at the edge of the umbrella, is formed on the upper central face of the wear plate 25. As shown in FIG. 4, a curvature 25*b* is suspended vertically from a position between the movable support base 11 and the fixed support base 4, and the curvature 25*b* is provided at the rear part of the wear plate 25.

At the bottom of the curvature 25*b*, a roller 27 is provided through an shaft 26 anchored by welding and the like. The upper face of the wear plate can be retained horizontally by contacting the roller 27 with the front face of the fixed support base 4.

Besides, a pair of open control levers 28, 28 which open the sack openings by entering into the opening 5*a* of the storage sack 5, are provided on the other supporting shaft 24 to be movable in both sides of the wear plate 25; the both levers 28, 28 are connected by means of a connecting arm 29, which is fixed to upper ends of said levers by welding and the like. In addition, the pair of open control levers 28, 28 can be made as independently movable relative to the arm 29, however, an embodiment of such movable levers 28, 28 is not shown in the present application.

As shown in FIG. 2, the structure is such that one end 29*a* of the connecting arm 29 bends forward; and by mounting a plumb 30 at the end of the curvature 29*a*, the open control lever 28 rotates in counterclockwise direction in FIG. 4; the lower end of the lever 28 is pressed to the front face of fore-front storage sack suspended by hanger 6.

In lower curvature 29*a* of said connecting arm 29, a connecting plate 31, which rotates the open control lever 28 in a clockwise direction in FIG. 4, is integrally provided on the front face of guide rail 13.

Figure 8C:
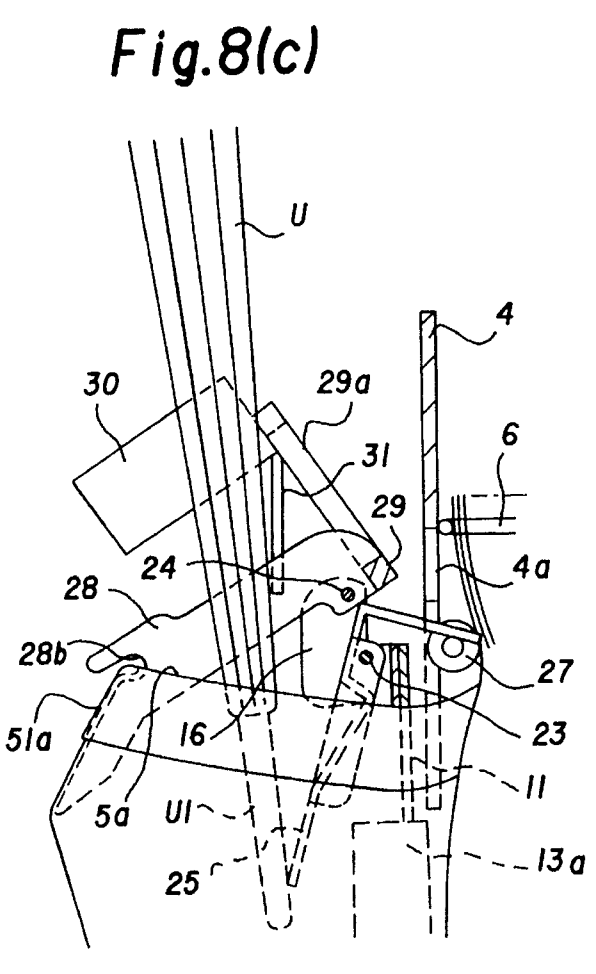
FIGS. 8(A), 8(B) and 8(C) are explanatory views of the storing operation.
Figure 8B:
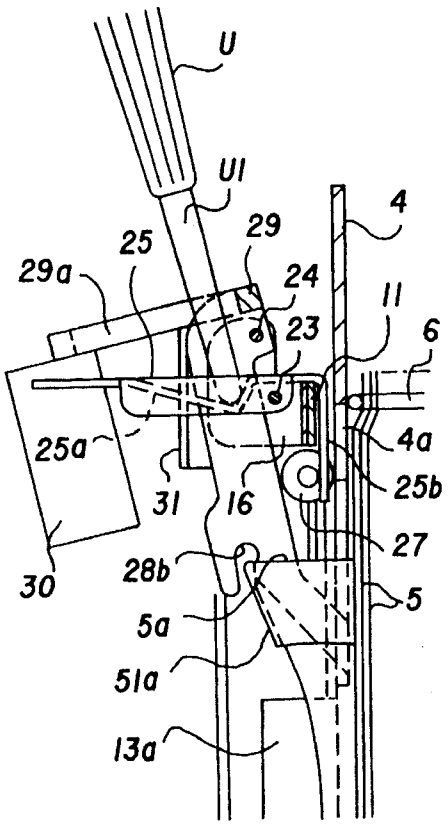
Figure 8A:
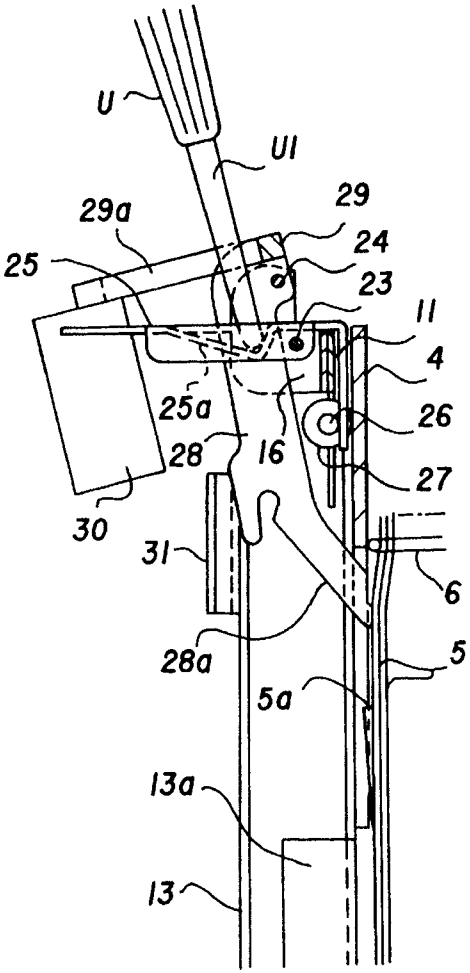

In the aforementioned structure, upon storing an umbrella U in the storage sack 5, as shown in FIG. 8*a*, press the umbrella U downward by contacting the shoe U1 of the edge of umbrella U with the upper face of the concave part 25*a* of the wear plate 25; and the roller 27, provided on the curvature 25*b* of the wear plate 25, as shown in FIG. 8B, moves downward together with the movable support base 11 against the ascending force power with the plumb 20, while contacting the roller 27 with the front face of the fixed support base 4 keeping the upper face of the wear plate 25 horizontal.

Accordingly, the open control lever 28 moves downward while pressing the end 28*a* on the upper front face of the opening 5*a* of the forefront storage sack 5; and then the end 28*a* of the open control lever 28 enters the opening 5*a* of the storage sack 5; in this case, should the upper part 51*a* of the fore side 51 be folded as mentioned above, the end 28*a* of the lever 28 can definitely enter into the opening 5*a*.

When the open control lever 28 further moves downward and the end 28*a* is entering into the opening 5*a*, the front side 51 of the storage sack 5 is gradually pulled outward and forward and the upper part 51*a* of the front side 51 enters into the concave area 28*b* on the open control lever 28, as shown in FIG. 8B. Simultaneously, the curvature 29*a* of the connecting arm 29 contacts with the connecting plate 31.

In the same state, when the open control lever 28 further moves downward, together with the movable support base 11, the open control lever 28 and the connecting arm 29 rotate in clockwise direction in FIG. 8B around the supporting shaft 24 against the descending force of the plumb 30. The opening 5*a* of the storage sack 5 opens wide, as shown in FIG. 8C, while entering the upper part 51*a* of the front side 51 of storage sack 5 into the concave area 28*b* of the open control lever 28.

Simultaneously, the wear plate 25 is lowered. The roller 27, provided on the curvature 25*b* of the wear plate 25, is removed from the central convex 4*a* (See FIG. 3) of the fixed support base 4. As shown in FIG. 8C, the wear plate 25 sweeps back by rotating in counterclockwise direction around the supporting shaft 23. As a result, the shoe U1 of the edge of umbrella U enters the storage sack 5 by slipping on the upper face of the wear plate 25 from the concave area 25*a* of the wear plate 25; and finally, the umbrella U is automatically stored in the storage sack 5 by further lowering the umbrella U.

The sack 5, in which the umbrella U is stored, can easily be taken out together with the umbrella U by pulling it out while lowering the device body 1 to remove the upper locking holes 5*b* of the storage sack 5 from the hanger 6.

Additionally, the movable support base 11 and the open control lever 28 automatically return as they are with plumbs 20, 30 by removing the umbrella U stored in the sack 5 forward. The roller 27, provided on the curvature 25*b* of the wear plate 25, moves in front of the fixed support base 4; and the wear plate 25 returns horizontally to a standby state.

As mentioned above, according to the present invention, umbrellas can easily be completely stored in each storage sack without using a motor or a vacuum pump to open the openings of the storage sacks.

The aforementioned embodiment is just an example, therefore, and structural changes on the aforementioned members are possible within the purpose of the present invention. For example, in the above preferred embodiment, rollers 12, 17 and long hole 16 are applied as a means to movably retain the movable support base 11 vertically. However, there are no limits to these means. Besides, plumbs 20, 30 are applied as means to ascend the movable support base 11 and to press the open control lever 28 to storage sack 5. However, another member, such as a spring, can be used.

Figure 9A:
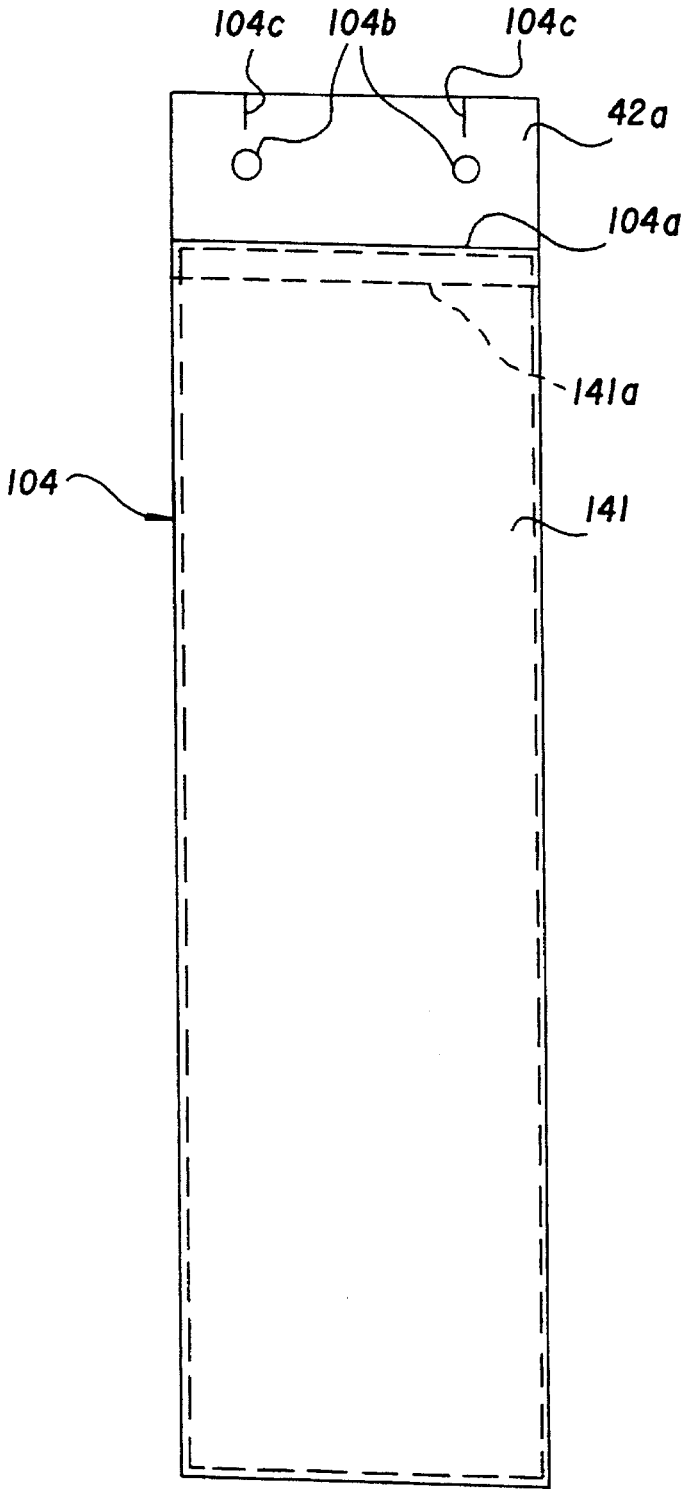
FIGS. 9(A) and 9(B) are, respectively, a front view and a section view of the storage sack.
Figure 9B:
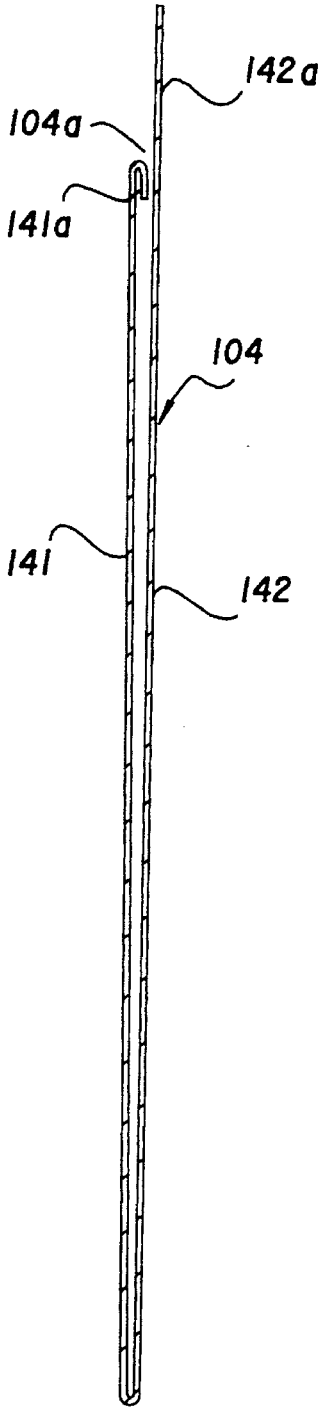

The other embodiment regarding the present invention is explained in the following, referring to FIG. 9 through FIG. 13:

FIG. 9 shows storage sack 104 applied in the embodiment. The storage sack 104 is formed from plastic film, and the like, to be flat cylinder-shaped; an opening 104*a* is provided in the upper part of the sack. The upper part 141*a* of the front side 141 of the opening 104*a* is folded to the rear side in a U-shape; the upper part 142*a* of the rear side 142 is projected further up than that of the front side 141; and a pair of locking holes 104*b* are provided on the projected portion.

Figure 10:
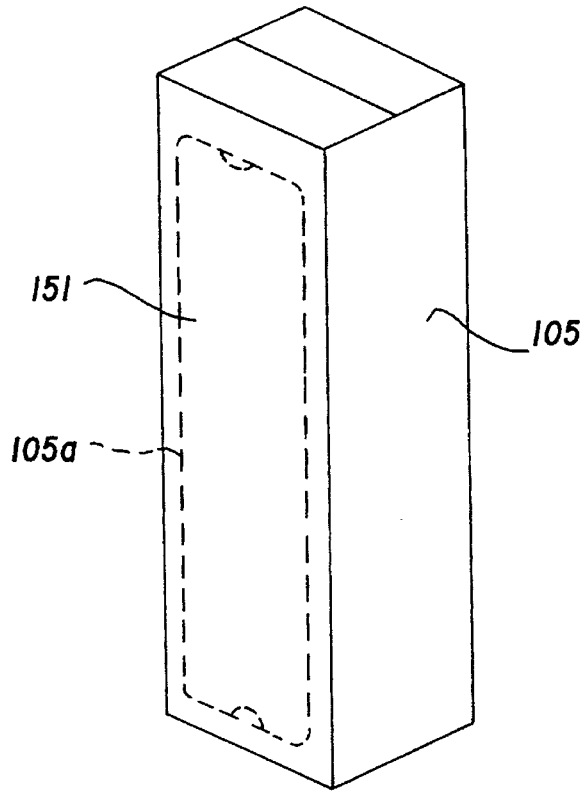
FIG. 10 is a perspective view of the storage container.

On the other hand, the aforementioned box 105, as shown in FIG. 10, is formed from corrugated fiberboard, and the like, and is longitudinally rectangular-shaped. A pair of bar-shaped hangers 107 are provided in the upper part inside the box 105.

Figure 11:
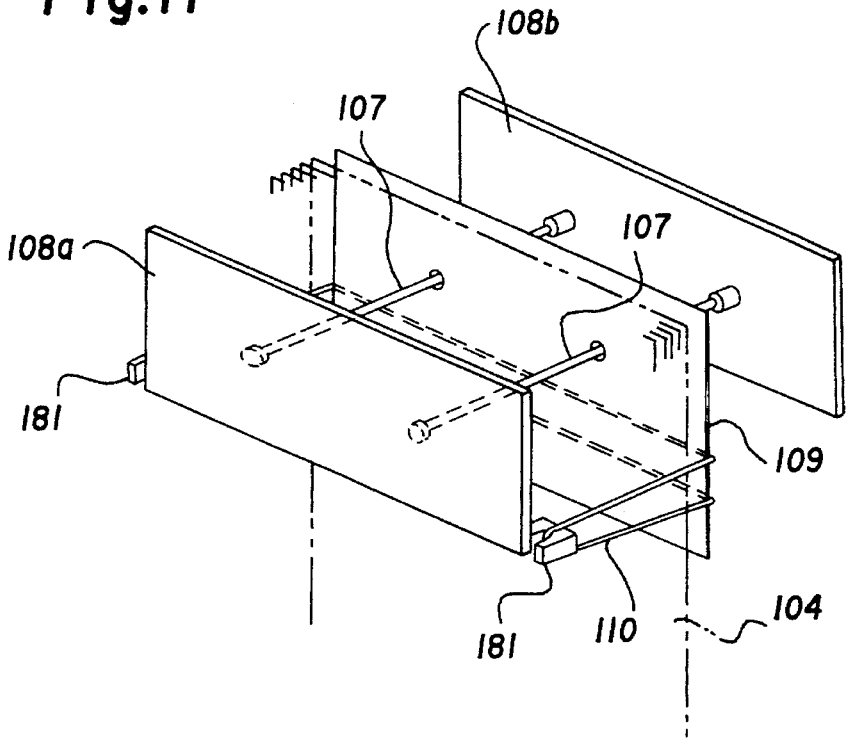
FIG. 11 is a perspective view of the suspending member for the storage sacks in order to retain them in such storage container.

A number of storage sacks 104 are suspended facing the fore side 141, on the left-hand side in FIG. 11, to retain them by mounting the hanger 107, FIG. 11, penetrating the locking holes 104*b* of said storage sacks 104 on the supporting plates 108*a*, 108*b* anchored on the upper face inside box 105. A pressure plate 109 is arranged on the rear side of the storage sacks 104; the pressure plate 109 presses a number of storage sacks 104 on the left-hand side in FIG. 11 by elastic members. In FIG. 11, rubber bands 110 are applied as elastic members; both ends of the rubber bands 110 are anchored to hook 181 provided horizontally at opposite ends of supporting plate 108*a*.

Figure 12:
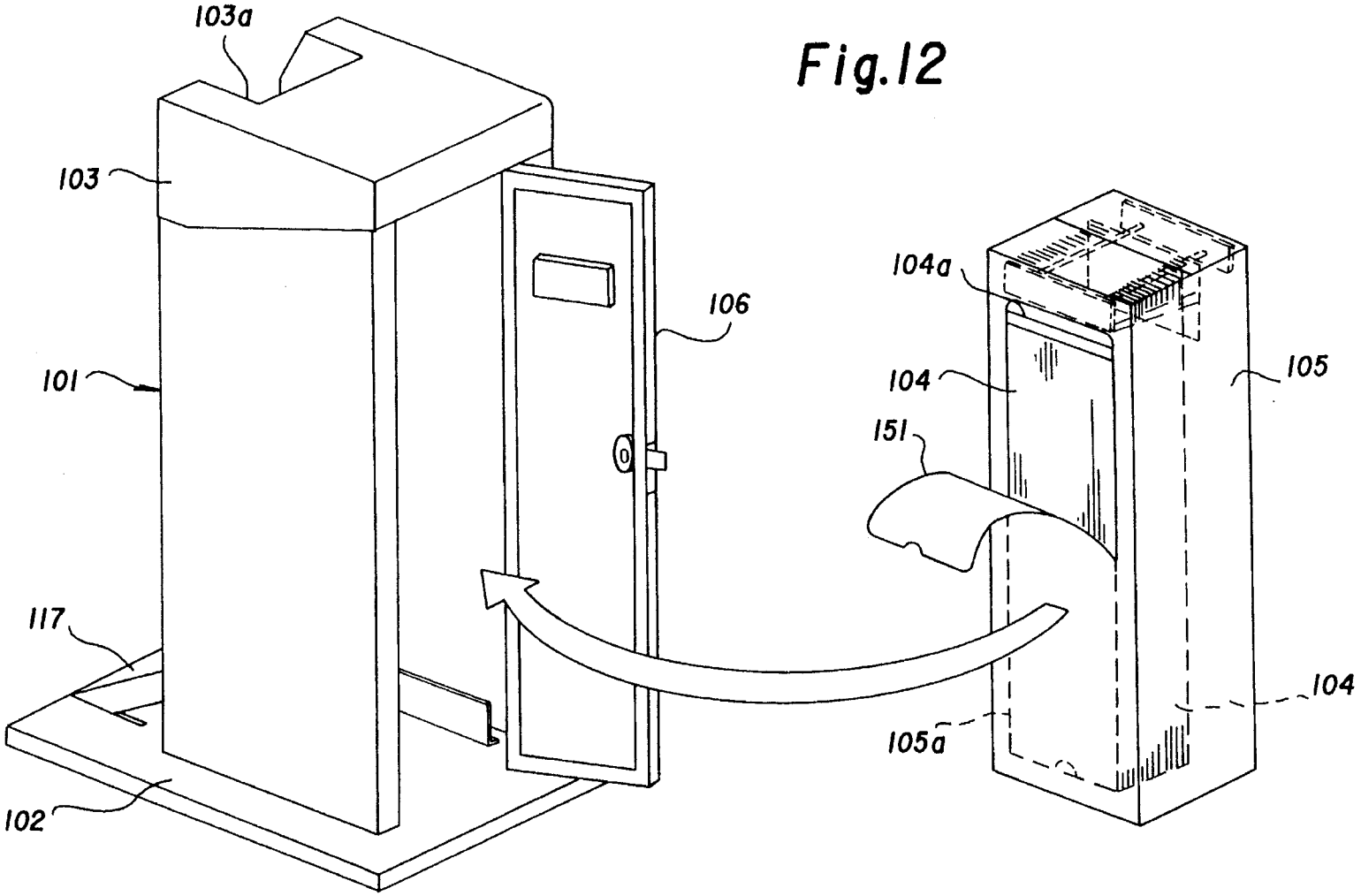
FIG. 12 is a perspective view showing the charging of the storage container into the device.

As shown in FIG. 10, an opening 151 which can open along with perforating scores 105*a* is provided on the front face of the box 105; the box can be transferred and stored without opening the opening 151 when it is not used. When it is used, as shown in FIG. 12, after the opening 151 is open along with the perforating scores 105*a*, open the switch door 106 provided on the rear side of the device body 101 to fill the box 105, with the opening 151 opened, into the device body 101.

An unillustrated fixed support member is provided inside the device body on the upper part of the box 105 placed in this device body 101. The box is set in a fixed position by contacting the front side of the fixed support member with the front face of box 105.

Figure 13:
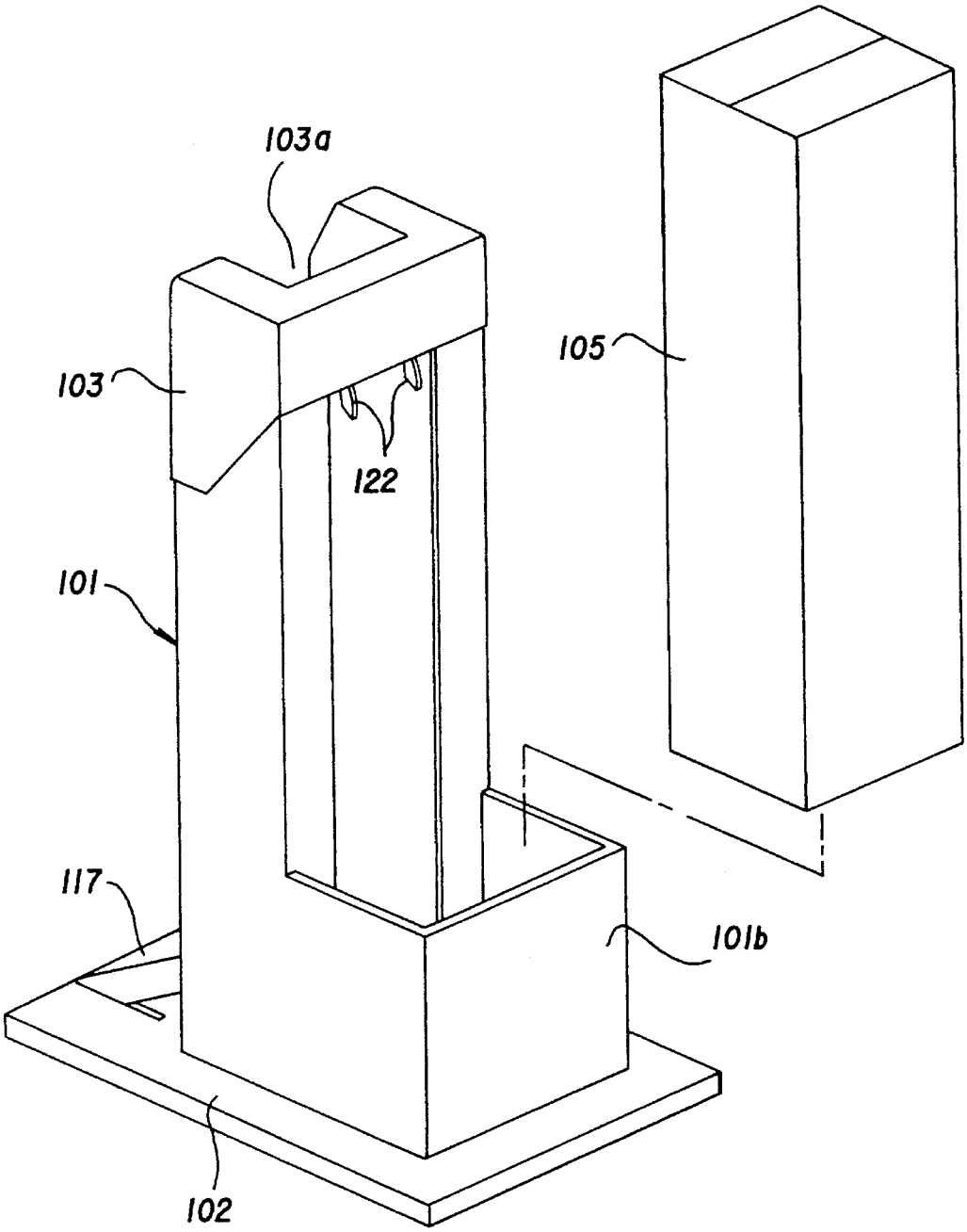
FIG. 13 is a perspective view showing another charging of the storage container into another embodiment of the device.

As shown in the aforementioned embodiment, the box 105, storing storage sacks for umbrellas is filled from the rear side to the device body 101. However, the box can be filled from the top of the device body 101 by opening the aforementioned cover 103. In addition, with regard to box 105, it is not necessary to cover up the all faces of the box by the device body 101, as shown in FIG. 1 to FIG. 12. For example, as shown in FIG. 13, a frame body 101*b* can be applied as a part of the device body to fill the box 105 into the frame 101*b* to determine the specified position to retain the box.

Besides, in the aforementioned embodiment, it is explained that the opening 104*a* of storage sack 104 is open by operating the open control levers 122. However, it can be opened by actuating vacuum suction in the prior embodiment.

Figure 14A:
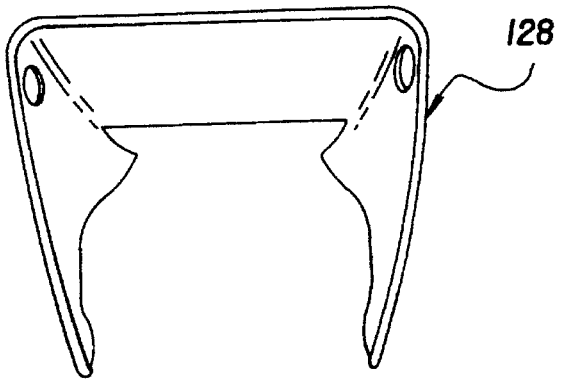
FIGS. 14(A) and 14(B) are a plan view and a front view of a bucket-shaped member, respectively.
Figure 14B:
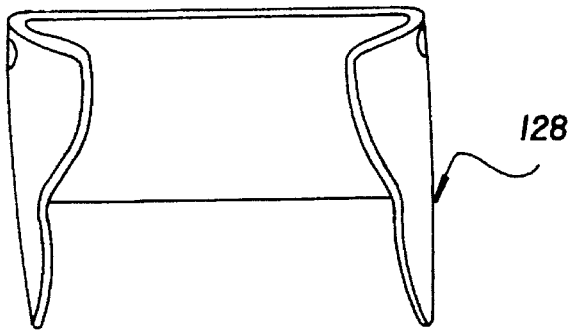
Figure 15:
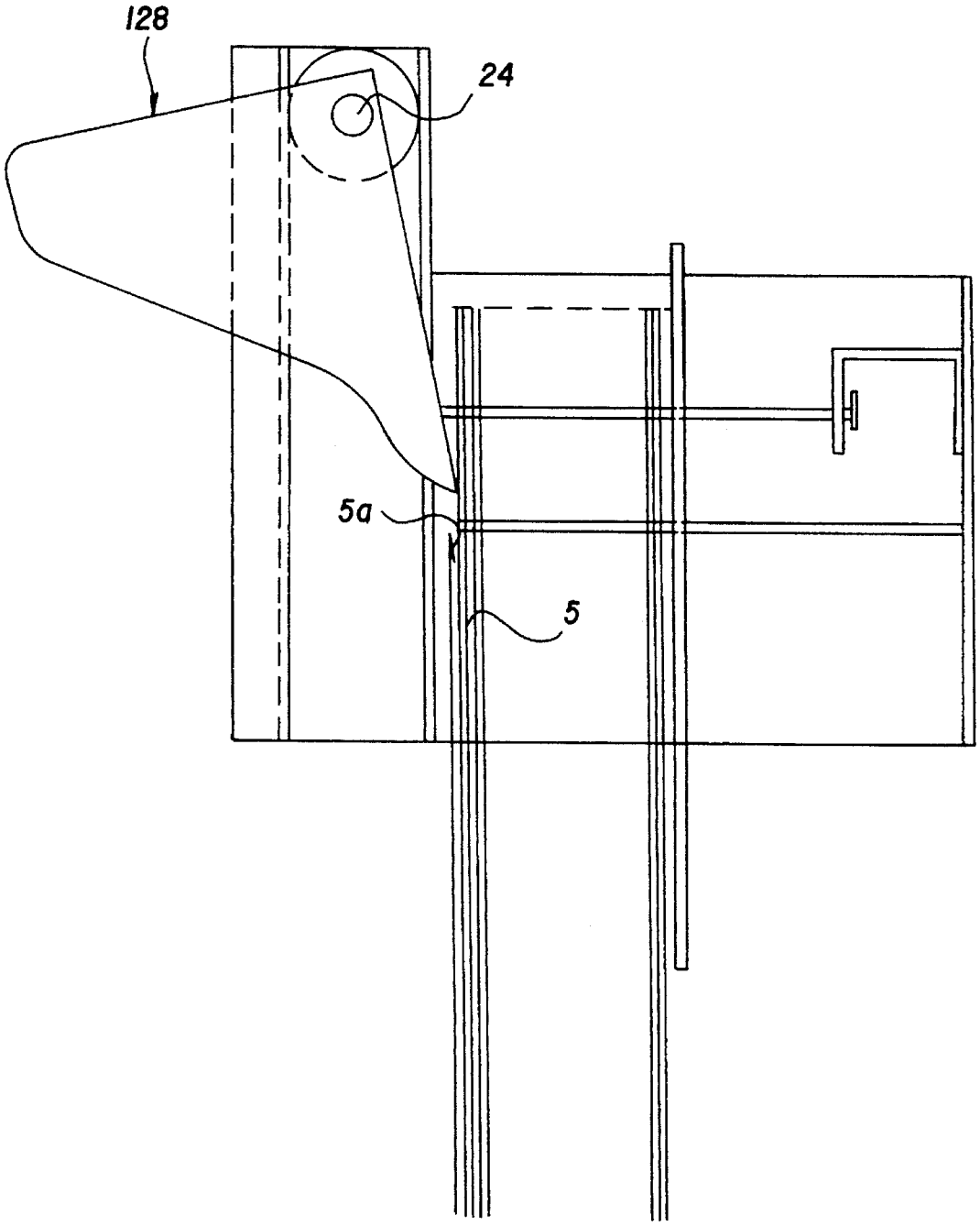
FIG. 15 and FIG. 16 are explanatory drawings showing different phase of the storing operation.
Figure 16:
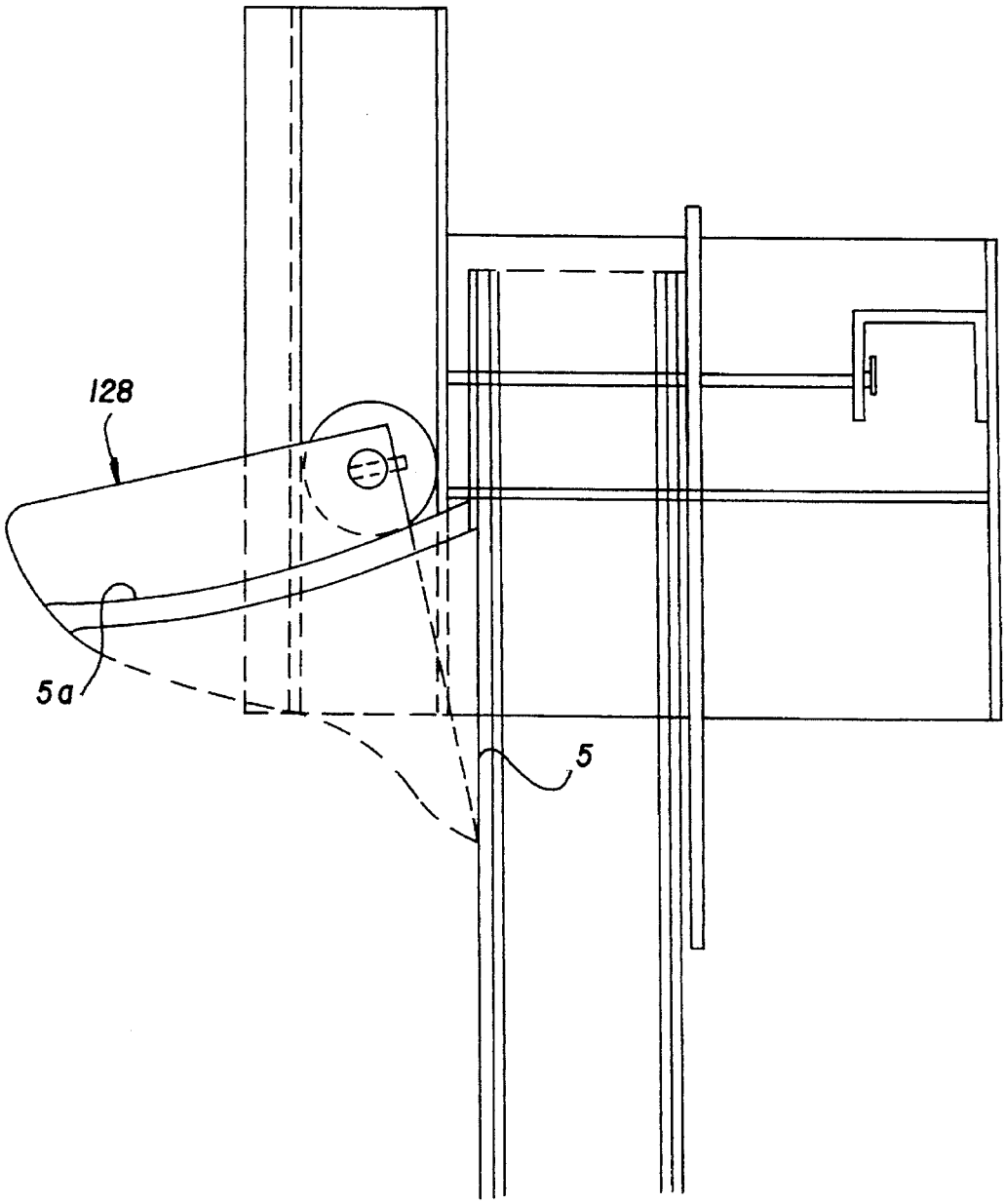

FIGS. 14 to 16 show the other embodiments regarding the present invention. In FIGS. 14A and 14B, the character 128 shows a bucket-shaped member integrally formed from plastic. Umbrellas can be smoothly inserted thanks to the shape of this member. Opening storage sacks 5 by this bucket-shaped member is shown in FIGS. 15 and 16, however, a detailed explanation is skipped because the state shown in FIGS. 15 and 16 is almost the same as that in FIGS. 8A, 8B and 8C.

Furthermore, instead of the above illustrated embodiment, a pair of open control levers can be structured to independently move movable support member; and means, which moves in the direction to contact the levers with storage sacks stored in the device body, can be structured to set independently to each lever. Thus storage sacks can certainly be open even if some misregistration occurs in the opening.

What is claimed:

1. A storage device for umbrella sacks comprising:

a device body storing a plurality of storage sacks;

a movable support base and a support means connected to said device body for supporting and guiding said movable support base for vertical movement relative to said device body;

a wear plate pivotably connected to said device body, and a means for releasing said movable support base actuated by movement of said wear plate, to allow said movable support base to be lowered as a result of contacting an edge of the umbrella to be stored in the sack;

open control levers connected to said wear plate adjacent said storage sacks, which open the openings of said storage sacks by pressing thereon during descending motion of said movable support base when lowering of the movable support base as a result of actuation of said said wear plate by contact with the edge of the umbrella, whereby said wear plate sweeps back by rotating downward to allow the umbrella to be inserted automatically into the storage sack.

2. Storage sacks according to claim 1, wherein said sack has an opening in the upper part; the upper part of the fore side of the opening is folded; the upper part of the rear side projects above that of the fore side; and locking holes are provided on the upper edge of the projected portion.

3. A storage device for umbrella sacks according to claim 1 wherein the openings of the storage sacks are open in order to store each umbrella; a number of storage sacks to be stored in the device body are firstly stored in a box; then the box is stored in the device body.

4. A storage device for umbrella sacks according to claim 3, wherein said storage sacks are suspended to retain them by applying hanger in said box.

5. A storage device for umbrella sacks according to claim 1 or 3, wherein said open control levers are an integral bucket-shaped member.

* * * * *